US007178176B1

(12) United States Patent
S-Cronenbold

(10) Patent No.: US 7,178,176 B1
(45) Date of Patent: Feb. 20, 2007

(54) MALE SPORTS/ATHLETIC PROTECTIVE UNDERGARMENT/CUP SYSTEM

(76) Inventor: Laurie A. S-Cronenbold, 185 Timber Rd., Newbury Park, CA (US) 91320

( * ) Notice: Subject to any disclaimer, the term of this patent is extended or adjusted under 35 U.S.C. 154(b) by 303 days.

(21) Appl. No.: 10/851,499

(22) Filed: May 24, 2004

(51) Int. Cl.
*A41D 13/00* (2006.01)

(52) U.S. Cl. ..... 2/466; 2/403; 602/72

(58) Field of Classification Search ..... 2/403, 2/466; 450/100, 102, 1, 114; 602/67–73
See application file for complete search history.

(56) References Cited

U.S. PATENT DOCUMENTS

| | | | | | |
|---|---|---|---|---|---|
| 1,006,432 | A | * | 10/1911 | Carter | 602/67 |
| 1,381,254 | A | * | 6/1921 | Thorp | 602/72 |
| 2,802,465 | A | * | 8/1957 | Brown | 602/68 |
| 3,176,686 | A | * | 4/1965 | Barnes | 128/846 |
| 3,499,443 | A | * | 3/1970 | Scheerer | 602/68 |
| 3,782,375 | A | * | 1/1974 | Donars | 602/72 |
| 3,788,314 | A | * | 1/1974 | Noreen | 602/67 |
| 4,014,044 | A | * | 3/1977 | Figueroa et al. | 2/466 |
| 4,141,357 | A | * | 2/1979 | Dietz | 602/68 |
| 4,257,414 | A | | 3/1981 | Gamm et al. | |
| 4,453,541 | A | | 6/1984 | Castelli et al. | |
| 4,599,751 | A | | 7/1986 | Bowhuis | |
| 4,967,768 | A | | 11/1990 | Tatro | |
| 5,003,972 | A | * | 4/1991 | Kestler | 602/70 |
| 5,012,802 | A | * | 5/1991 | Bischoff | 602/73 |
| 5,274,854 | A | | 1/1994 | Wenner et al. | |
| 5,295,267 | A | * | 3/1994 | Galindo | 2/466 |
| 5,636,387 | A | | 6/1997 | Lundy | |
| 5,819,323 | A | | 10/1998 | Edenfield | |
| 5,920,914 | A | | 7/1999 | Dempsey | |
| 6,319,219 | B1 | * | 11/2001 | Landi | 602/67 |

* cited by examiner

*Primary Examiner*—Gary L. Welch
*Assistant Examiner*—Richale L. Haney
(74) *Attorney, Agent, or Firm*—J. E. McTaggart

(57) ABSTRACT

An improved male sports/athletic undergarment/cup protective system provides maximum comfort, avoiding stress on the protected body parts while holding the cup securely in its optimal location in the undergarment. A conventional rigid cup is totally covered with a conformal sheath of soft fabric material and fitted externally with a triangular pattern of three snap fastener members made and arranged to removably engage three complementary snap fastener members attached in a matching triangular pattern inside the front panel of a sports/athletic undergarment. The interior layer of the fabric sheath is retained conformal to the interior surface of the cup, and the cup is secured against any shift or creep relative to the sheath and an attached undergarment. by a plurality of sewn-through points at each of which the exterior layer is seized together with the interior layer by loops sewn through vent openings configured in the cup.

7 Claims, 3 Drawing Sheets

MALE SPORTS/ATHLETIC PROTECTIVE UNDERGARMENT/CUP SYSTEM

FIELD OF THE INVENTION

The present invention relates to the field of sports and athletic apparel and equipment and more particularly to a method and structure for supporting a protective cup in male sports underwear in a manner that enhances comfort, convenience and effectiveness.

BACKGROUND OF THE INVENTION

Protection for the genitals of males engaging in sports and athletic activities has been known and practiced for many years in the form of a metal or plastic cup held in place by straps or special underwear. Regarding cup material, past use of metal has been replaced by current use of high-impact plastic materials.

Such protection is usually mandated for males in all forms of sports and athletics, amateur and professional, youths and adults. There are available a variety of protective systems, the most common of which, referred to as "jock strap" type, consists of a pouch or pocket of stretchable fabric material containing the cup, attached to typically three straps: one to surround each leg and a waist band which is typically made substantially wider than the two leg straps. Typically all three straps are made as loops of elastic webbing material, in a range of different youth and adult sizes. For most professional and serious sports activities, where dressing or locker rooms are available, the protector cup and its "jock strap" are typically worn, along with other sports uniform or attire, only for the duration of the sports or athletic event, due to some degree of discomfort, so typically pro sports undergarments are exchanged for regular underwear in changing to regular street attire. However the pouch/pocket is usually made such that the cup can be removed temporarily if desired.

For youngsters and casual sports events, special sports/athletic underwear, equipped with a pouch/pocket to support a cup, is made of soft stretchable material and is made comfortable enough to be worn at times as regular underwear with the cup removed. This of great convenience for after-school youth sports or athletic events in locations where changing/locker rooms are not available and where a complete change of attire is unnecessary or undesired.

Unfortunately, the actual real-world experience, especially by boys of school age and their parents, has found the conventional available undergarment protection apparel to fall far short of being satisfactory regarding comfort and/or security of placement, due to fundamental problems inherent in the implementation of such protective apparel of known art.

DISCUSSION OF KNOWN ART

As examples of the conventional jock-strap type, with closed loop elastic web leg straps and waist bands about one inch and 2¾ inches wide respectively, a polyester product marked VK/Venus Athletic Wear, Murray Hill, N.J. 07974 in at least an adult small size (S), provides a pouch of soft fabric that is stretchable to about 200% horizontally and 120% vertically, accessed at its inside top region, held closed by two snap domes, while a product trademarked TRU-FIT, made in Taiwan in at least a "youth-small" size, provides a pouch of much firmer fabric that stretches only to about 115% (H&V), accessed at the top outside frontal region, closed by a flap of material.

As an example of what might be termed a "romper" style, a product marked BIKE (RN 58322) has a full rear panel of soft fabric with nap, stretchable 200% (H&V) stretchable fabric and a top-inside-access pouch of non-nap material, stretchable to about 200% H and 110% V. A large single circular leg-opening and a top opening of the pouch have an elastic hem sewn in place.

A sports/athletic compression-type underpant, marked "reusch" (R)p made in USA of "80% NYLON 20% Du Pont LYCRON(R)" material that is stretchable to about 175% HV, is configured with padded flanks extending down to near the bottom of leg portions extending down about 6" from the crotch, where the cap is retained in a double-walled stretch-fabric compartment accessed from top inside.

U.S. Pat. No. 4,453,541 to Castelli et al, for ATHLETIC SUPPORTER exemplifies the "jock strap" concept of a waist band and a pair of leg straps, and shows a typical cup on the cover page and in FIG. 4.

U.S. Pat. No. 4,967,768 to Le Ann M. Tatro for MALE SHORTS HAVING PROTECTIVE CUP SUPPORTER discloses shorts of a type having elastic body-gripping waist and leg apertures and having a sewn-in pocket to receive the protective cup.

U.S. Pat. No. 5,920,914 to Kate B. Dempsey for PROTECTIVE MALE UNDERGARMENT discloses such including a pouch for retaining a protective cup, and a slit for allowing urination without lowering the garment.

U.S. Pat. No. 4,237,414 for ATHLETIC PROTECTOR CUP exemplifies essentially rigid protective cups, and illustrates the normal configuration with ventilation apertures and an enlarged resilient molded rounded peripheral edge structure.

U.S. Pat. No. 6,319,219 for ATHLETIC PROTECTOR CUP teaches a cup with two layer structure for additional impact resistance.

The variety of configurations and stretch properties of the fabric materials found in the actual products as well as in the patents of known art are symptomatic of the underlying unsolved problem of incompatibility between fastening security and wearer comfort inherent in conventional approaches and practices in this field.

OBJECTS OF THE INVENTION

It is a primary object of the present invention to provide a system of male sports/athletic protection including a rigid protective cup and a related supportive undergarment that provide improvements in wearer comfort as well as security of retention in place during deployment.

It is a further object that the cup should be readily removable while wearing the undergarment in place, and that the undergarment should be suitable to wear as regular underwear for ordinary activities other than sports and athletics.

SUMMARY OF THE INVENTION

The foregoing objects have been accomplished in the present invention of a sports/athletic male protective system wherein a conventional rigid cup is totally covered with a conformal sheath of soft fabric material and fitted externally with a triangular pattern of three snap fastener members made and arranged to removably engage three complementary snap fastener members attached in a matching triangular pattern to an interior frontal region of a sports/athletic undergarment. The interior layer of the fabric sheath is retained conformal to the interior surface of the cup, and the cup is secured against any shift or creep relative to the sheath and an attached undergarment by a plurality of sewn-through points at each of which the exterior layer is seized together with the interior layer by loops sewn through vent openings configured in the cup.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
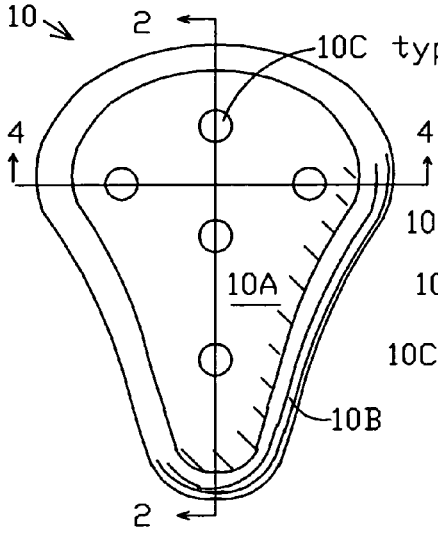
FIG. 1 PRIOR ART
FIG. 1 is a front elevation view of a rigid protective cup of known art.

FIG. 1 is a rear elevation view of a protective cup 10 shown as a typical example of conventional practice of known art, showing the convex exterior surface of the cup. The main body 10A is typically formed from a rigid plastic material and is fitted around its periphery with a compliant rim 10B of rubbery material held in place by its own elasticity. Ventilation is provided by an array of openings 10C: five circular openings 10C in this example, located as shown.

Figure 2:
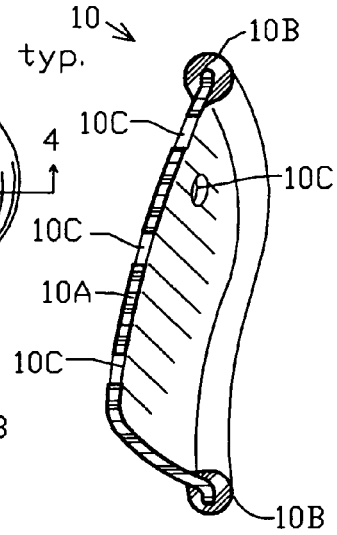
FIG. 2 PRIOR ART
FIG. 2 is a cross-section taken through axis 2—2 of the cup of FIG. 1.

FIG. 2 is a cross-section through axis 2—2 of the protective cup 10 of FIG. 1 showing the shape of rigid main body 10A in profile with compliant rim 10B at the periphery of main body 10A. The periphery of cup 10 is shaped to fit against an appropriate frontal crotch region of the human body and to substantially enclose and protect the male genitals. Visible in this view are four vent openings 10C of the total of five.

Figure 3:
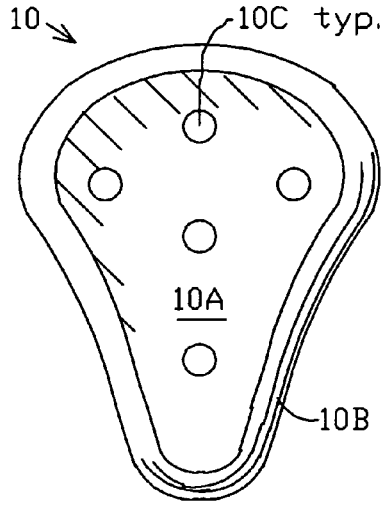
FIG. 3 PRIOR ART
FIG. 3 is a rear elevation view of the protective cup of FIG. 1.

FIG. 3 is a rear elevation view of the protective cup 10 of FIG. 2 showing the concave interior of main body 10A as seen from a rear viewpoint opposite that of FIG. 1, showing the peripheral compliant rim 10B and the five vent openings 10C.

Figure 4:
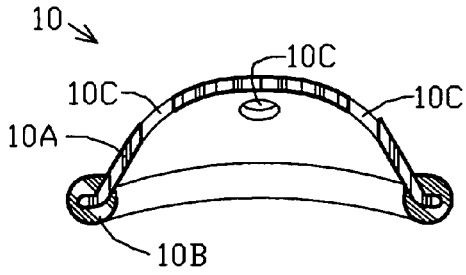
FIG. 4 PRIOR ART
FIG. 4 is a cross-section taken through axis 4—4 of the cup of FIG. 1.

FIG. 4 is a cross-section through axis 4—4 of the protective cup 10 of FIG. 1, showing the shape of main body 10A and the peripheral compliant rim 10B, and showing three vent openings 10C of the five total.

Figure 5:
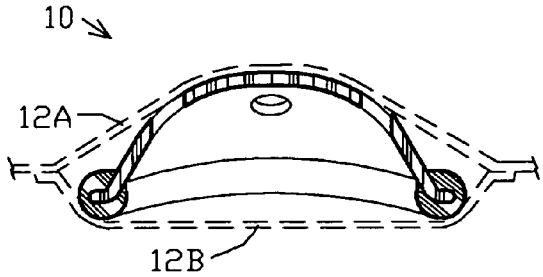
FIG. 5 PRIOR ART
FIG. 5 shows the subject matter of FIG. 5 deployed in the conventional manner in a sports/athletic undergarment of known art, shown in part.

FIG. 5 shows the protective cup 10 of FIG. 5 deployed between a frontal layer 12A and rear sewn-in panel 12B of a sports/athletic undergarment of known art, shown in part. Typically the fabric in panels 12A and 12B of the undergarment is selected to be moderately stretchable: at least in the horizontal direction, and in some products, at least partially in the vertical direction.

The two undergarment panels 12A and 12B, sewn together as shown, form a pocket or pouch, typically open at the top for insertion of the cup 10. Alternatively the pocket/pouch can be formed by adding a pocket/pouch front panel and sewing it in place onto the front of the undergarment which then forms the rear panel of the pocket/pouch.

In other forms of known products, the pocket/pouch may be formed as a separate item and attached at top and/or bottom to the undergarment.

It is typical for the pocket or pouch to be dimensioned such that, prior to deployment. the fabric in the rear panel 12B becomes in effect "stretched" across the rim of the cup as shown. Then, when deployed, the protected body parts must force rear panel 12B into the cup, thus further stretching the fabric of panel 12B, developing tensional stress in the material that can cause pain or at least discomfort to the wearer.

The foregoing problem can be alleviated by making the pocket/pouch wider in size, however that introduces another problem by allowing the cup 10 to move out of place sideways, and thus varying the width of the pocket/pouch merely alters the tradeoff between these two inherent shortcomings of conventional products in this field. Similarly the variations in fabric material properties, e.g. regarding stretchability, found in various undergarment products in this field, cover a wide range that has still failed to provide a satisfactory "happy medium".

Despite extensive research on behalf of her own sons involving a wide range of conventional sports/athletic protective undergarments, the inventor found it impossible to find any product on the market that provides a satisfactory solution to these problems amongst commercially available products.

Figure 6:
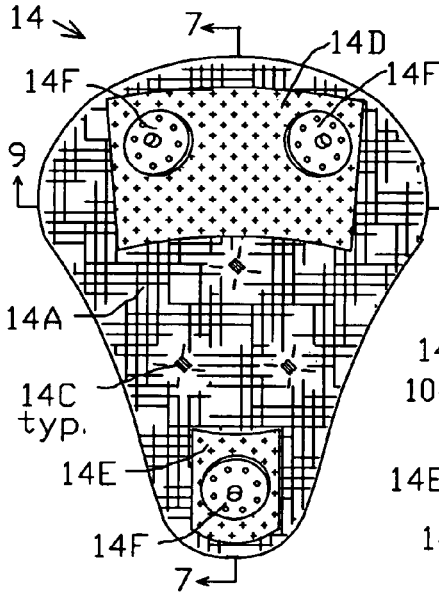
FIG. 6 is a front elevation view showing the convex exterior of a fabric-covered rigid protective cup in accordance with the present invention.

FIG. 6 is a rear elevation view of a fabric-covered rigid protective cup 14 in accordance with the present invention. The entire surface of a rigid plastic cup, which can be the same as cup 10 in FIGS. 1–4, is covered with a lightly padded sheath of fabric, of which the exterior layer 14A is seen in FIG. 6; it is firmly stretched over the front side of the cup, wrapped around the periphery and extending further to form an internal layer which is held in place in a conformal manner against the concave interior surface by an array of seven sewn-through seizing points 14C, three of which appear in FIG. 6, where the exterior layer 14A is held together with the interior layer by the seven sewn-through seizing points 14C each having loops of thread traversing a corresponding opening in the cup (e.g. circular vent holes 10C in FIG. 1).

A reinforcement pad 14D of firm fabric, sewn onto exterior layer 14A in an upper region of cup 14, form the support base to which are attached two snap fastener members 14F located as shown, located approximately 2⅛ inches apart. Similarly a smaller reinforcement pad 14E sewn onto exterior layer 14A in a lower region of cup 14 forms the support base to which is attached a third snap fastener member 14F, located approximately 3⅞ inches beneath the other two snap fastener members 14F above.

Figure 7:
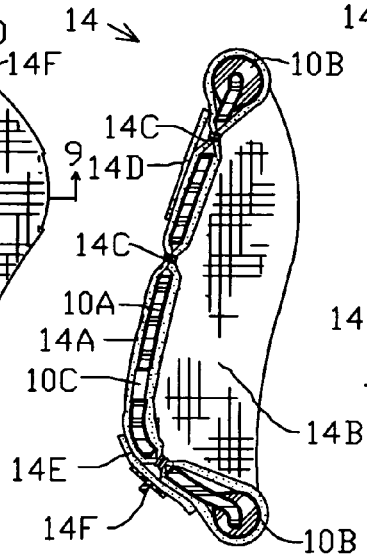
FIG. 7 is a cross-section of the fabric-covered protective cup of FIG. 6, taken through axis 7—7.

FIG. 7 is a cross-section through axis 7—7 of the fabric-covered protective cup 14 of FIG. 6, showing the main body 10A and compliant rim 10B fully surrounded by the fabric sheath with exterior panel 14A and interior panel 14B, held together by seven sewn-through seizing points 14C, three of which, being located on axis 7—7 (FIG. 6), are visible in this view: one behind upper reinforcement pad 14D and one behind lower reinforcement pad 14E and snap fastener member 14F.

Figure 8:
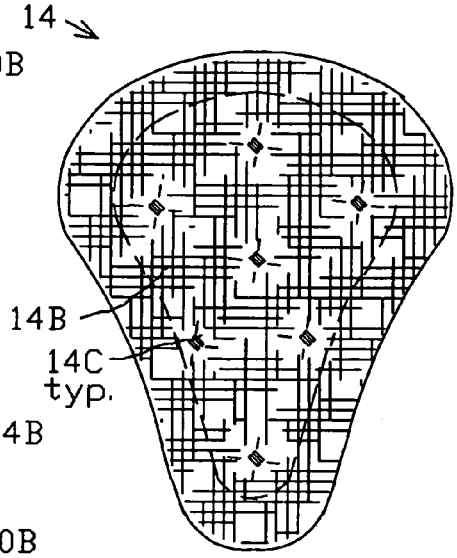
FIG. 8 is a rear elevation view showing the concave interior of the fabric-covered protective cup of FIGS. 6 and 7.

FIG. 8 is a rear elevation view of the fabric-covered protective cup of FIG. 6 showing the concave internal layer 14B with seven sewn-through seizing points 14D. The inner outline of the peripheral resilient rim is indicated as a dashed line.

Figure 9:
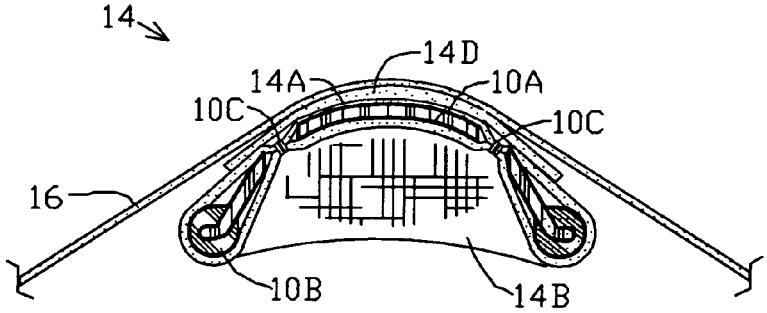
FIG. 9 is a cross-section of the fabric-covered protective cup of FIGS. 6–8 taken through axis 9—9 of FIG. 6.

FIG. 9 is a cross-section taken through axis 9—9 of the fabric-covered protective cup of FIG. 6, shown in a deployed location relative to a portion of a front panel 16 of an associated support undergarment for sports and/or athletic activities. It is seen that the conformal location of the internal layer 14B of soft e fabric is secured by sewn-through points 10C with loops of thread traversing openings in the main body 10A of the cup and encompassing internal layer 14B and external layer 14A. Reinforcement pad 14D is seen interposed between front panel 16 and external layer 14A.

Figure 10:
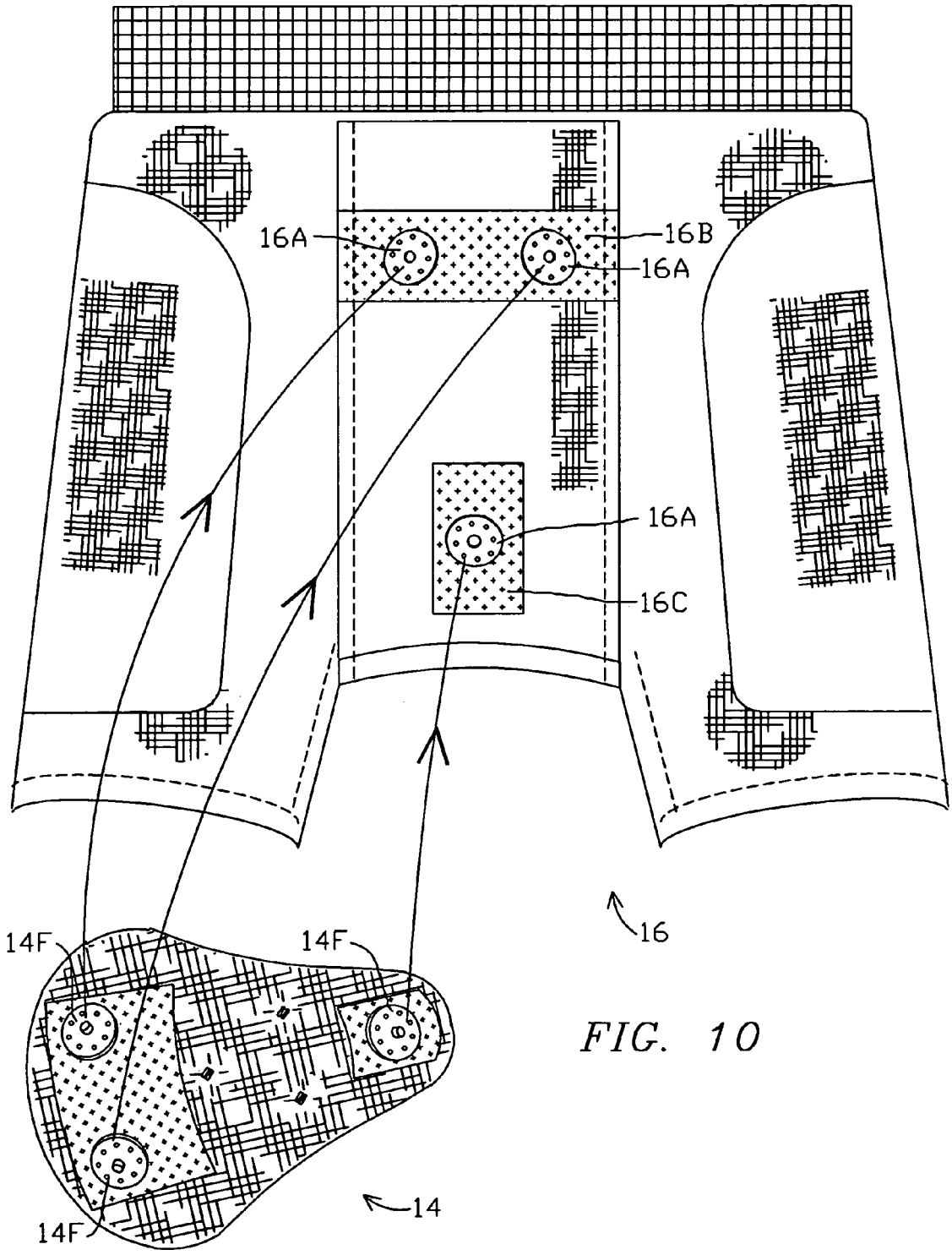
FIG. 10 depicts a male protective system in accordance with the present invention: a sports/athletic undergarment shown in an interior view of the front panel thereof, fitted with three snap fastener members, and a fabric-covered rigid cup fitted with three corresponding snap fastener complementary members, as in FIGS. 6–9.

FIG. 10 depicts, in a male protective system in accordance with the present invention, a rear view of the front panel 16 of a sports/athletic undergarment, fitted with three snap fastener members 16A, and, shown beneath, a fabric-covered rigid cup 14 fitted with three corresponding snap fastener complementary members 14F mounted on reinforcing pads as described above in connection with FIG. 6. In front panel 16, the upper pair of snap fastener members 16A are attached to reinforcing pad 16B, and the lower snap fastener member 16A is attached to reinforcing pad 16C; the pads 16B and 16C are sewn to the front panel 16 of the undergarment.

The three arrows and dashed lines show how the cup 14 is to be moved into place and the snap fastener members 14F engaged to their counterpart members 16A so as to hold the cup 14 in place against the rear side of the front panel 16 of the undergarment, as shown in FIG. 9.

The numerous sewn-through seizing points 14C (seven in the illustrative embodiment) ensure that there can be no shifting or creeping of the cup 14 relative to the fabric sheath, and serves along with the snap fastening of the sheath to front panel 16 of the undergarment to hold the cup 14 securely in place, particularly with the compression type undergarment shown.

It is recommended that fastener members 14F on the fabric covered cup 14 be the snap fastener portion with the protruding dome, so that the mating portion 16A in the undergarment, having only opening receptacles, will not cause any discomfort when worn with cup 14 removed.

The fabric covered cup 14 can be readily laundered whenever required.

The invention can be practiced by applying fabric covering as described above to conventional protective cups of virtually any size, shape and material. If existing vent holes are insufficient, additional holes may be drilled as required.

The quantity and locations of the sewn-through seizing points may vary from the seven shown, as a matter of design choice. The basic undergarment, to which the fastenings are added in accordance with the invention, may be of virtually any size and in any available style of known or new art: including the conventional elastic jock strap type, boxer shorts, romper style with elastic leg openings, etc.

As alternatives to the three pairs of snap fasteners shown and described above in connection with an illustrative embodiment, the invention can be practiced with other types of fasteners such as hook and eye, Velcro hook and loop, or zippers, and the quantity may be other than three pairs.

The reinforcement pads 16B/16C shown are recommended, particularly if the undergarment is made from soft stretchable material, however, as a matter of design discretion, the pads may not be required with some sports/athletic undergarment products made if the materials are already sufficiently firm.

As an alternative to the fabric sheath being closed as shown and described in connection with the illustrative embodiment, the invention could be practice with some portion of the sheath open, e.g. at the top, with or without a flap and/or fastenings. Also it is not essential that the entire exterior surface of the cup be covered by the sheath; e.g. a central opening in a region in which there are no sewn-through seizing points.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An undergarment/cup protective system for males in sports and athletics comprising:

a rigid protective cup having a concave interior surface and a convex exterior surface, and being configured with a pattern of vent openings;

a sheath of soft fabric substantially covering said rigid protective cup, including an inner layer conforming to the interior surface and an outer exterior layer conforming to the exterior surface, the inner and the outer layers being attached together by a plurality of seizing points, each comprising a loop of thread sewn through a corresponding one of the vent openings, whereby the inner layer is held in conformance with the interior surface and both layers are secured against shifting and displacement relative to said cup;

a plurality of first type fastener members attached onto the exterior layer in a predetermined pattern;

a sports/athletic undergarment having a front panel with an inside surface; and a plurality of second type fastener members attached onto the inside surface of the front panel of said undergarment arranged and located in the predetermined pattern such that each second type fastener member can removably engage a corresponding one of the first type fastener members on said cup so as to hold said cup in a desired location behind the front panel of said undergarment.

2. The protective system as defined in claim 1 further comprising a reinforcement pad of fabric sewn in place between each of said first type fastener members and the exterior layer of fabric on said cup.

3. The protective system as defined in claim 1 further comprising a reinforcement pad of fabric sewn in place between each of said second type fastener members and the inside surface of the front panel of the undergarment.

4. The protective system as defined in claim 1 wherein:

said array of first type fastener members comprise three dome portions of snap type fasteners arranged in an isosceles triangle pattern with two fastener members in an upper region of the exterior layer of said cup and one fastener member in a lower region thereof; and said array of second type fastener members comprise three receptacle portions of snap type fasteners arranged in the same isosceles triangle pattern on the rear side of the front panel of said undergarment, so as to be removably engagable with said cup.

5. A method of attaching a male protective sports/athletic cup to a sports/athletic undergarment for increased comfort and improved cup-to-undergarment security, comprising the steps of:

(a) ensuring that the cup is configured with a predetermined pattern of vent openings;

(b) enclosing the cup in a soft fabric sheath including an exterior layer and an interior layer;

(c) sewing a plurality of seizing loops, through a selected corresponding plurality of the vent openings, so as to seize the exterior and interior layers together at the selected vent openings so as to hold the inner layer in conformance with the cup internally and to secure both layers against shifting and displacement relative to the cup;

(d) attaching a plurality of fastener members of a first removably-engaging type in a designated pattern on the exterior fabric layer of the cup;

(e) attaching a corresponding plurality of fastener members of a complementary second removably-engaging type in the designated pattern on an inside front panel of the sports/athletic undergarment; and (f) attaching the cup to the undergarment by engaging each first type fastener member to a corresponding second type fastener.

6. The method of attaching a male protective sports/athletic cup to a sports/athletic undergarment as defined in claim 5, wherein step (d) further comprises the preliminary step of sewing in place a plurality of reinforcement pads at intended fastener locations on the exterior fabric layer on the cup.

7. The method of attaching a male protective sports/athletic cup to a sports/athletic undergarment as defined in claim 5, wherein step (e) further comprises the preliminary step of sewing in place a plurality of reinforcement pads at intended fastener locations on the rear of the front panel of the undergarment.

* * * * *